United States Patent [19]

Burns

[11] Patent Number: 4,686,063

[45] **Date of Patent: * Aug. 11, 1987**

[54] FATTY PEROXYACIDS OR SALTS THEREOF HAVING AMIDE MOIETIES IN THE FATTY CHAIN AND LOW LEVELS OF EXOTHERM CONTROL AGENTS

[75] Inventor: Michael E. Burns, West Chester, Ohio

[73] Assignee: The Procter & Gamble Company, Cincinnati, Ohio

[ * ] Notice: The portion of the term of this patent subsequent to Jan. 6, 2004 has been disclaimed.

[21] Appl. No.: 907,207

[22] Filed: Sep. 12, 1986

[51] Int. Cl.[4] ..... C11D 7/54

[52] U.S. Cl. ..... 252/102; 252/95; 252/99; 252/186.25; 252/186.26; 252/186.27; 252/186.44; 260/502 R

[58] Field of Search ..... 252/95, 99, 102, 186.25, 252/186.26, 186.27, 186.44; 260/502 R

[56] References Cited

U.S. PATENT DOCUMENTS

| | | | |
|---|---|---|---|
| 3,442,937 | 5/1969 | Sennewald et al. | 260/502 R |
| 4,100,095 | 7/1978 | Hutchins et al. | 252/95 |
| 4,529,534 | 7/1985 | Richardson | 252/95 |
| 4,634,551 | 1/1987 | Burns et al. | 252/102 |

*Primary Examiner*—Paul Lieberman
*Assistant Examiner*—Hoa Van Le
*Attorney, Agent, or Firm*—Robert B. Aylor; Richard C. Witte; Thomas H. O'Flaherty

[57] ABSTRACT

This invention relates to peroxyacids having polar amide links in the hydrophobic chains and low levels of exotherm control agents.

19 Claims, No Drawings

FATTY PEROXYACIDS OR SALTS THEREOF HAVING AMIDE MOIETIES IN THE FATTY CHAIN AND LOW LEVELS OF EXOTHERM CONTROL AGENTS

BACKGROUND OF THE INVENTION

Technical Field

This invention relates to the stabilization of peroxygen bleaching compounds.

SUMMARY OF THE INVENTION

The present invention relates to a bleaching composition comprising the mixture of:

(1) peroxyacid compound of the following general formulas:

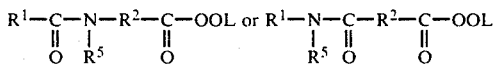

wherein $R^1$ and $R^2$ are alkyl(ene), aryl(ene) or alkaryl(ene) groups containing from about 1 to about 14 carbon atoms; $R^5$ is H or an alkyl, aryl, or alkaryl group containing from about 1 to about 10 carbon atoms; and L is either H or $Mg^{2+}X_{2-n}$ l. $YH_2O$ wherein X is a compatible anion, n is one or two, and Y is from 0 to about 6; and (2) exotherm control agent selected from the group consisting of boric acid, urea, and mixtures thereof at a weight ratio of exotherm control agent to peroxyacid compound of from about 0.2:1 to, preferably, less than about 1:1 for the boric acid and from about 0.5:1 to, preferably, about 2:1 for the urea.

The invention also relates to bleaching compositions which contain one of the above mixtures. In a preferred embodiment, the bleaching compositions are incorporated into detergent compositions.

DETAILED DESCRIPTION OF THE INVENTION

The invention relates to amide substituted peroxyacid compounds of the following general formulas:

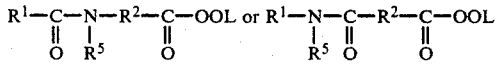

wherein $R^1$ is an alkyl, aryl, or alkaryl group containing from 1 to about 14 carbon atoms, $R^2$ is an alkylene, arylene, or alkarylene group containing from 1 to about 14 carbon atoms, and $R^5$ is H or an alkyl, aryl, or alkaryl group containing 1 to about 10 carbon atoms and L is as defined hereinbefore. Such peracids require only low levels of the specified exotherm control materials.

$R^1$ preferably contains from about 6 to about 12 carbon atoms. $R^2$ preferably contains from about 2 to about 8 carbon atoms. $R^1$ can be alkyl, aryl or alkaryl containing branching, substitution, or both. Analagous structural variations are permissible for $R^2$. The substitution can include alkyl, aryl, halogen, nitrogen, sulfur, and other typical substituent groups of organic compounds. $R^5$ is preferably H. $R^1$ and $R^5$ should not contain more than 18 carbon atoms total.

The peroxyacid compounds of the invention provide effective and efficient surface bleaching of textiles which thereby removes stains and/or soils from the textiles. The compounds are particularly efficient at removing dingy soils from textiles. Dingy soils are those that build up on textiles after much usage and washing, and result in a gray or yellow tint on a white textile. These soils are a blend of particulate and greasy materials.

The compounds of the invention provide effective bleaching over a wide range of temperature (5° C. to 85° C.), a preferred range being from about 30° C. to about 60° C. The compounds can also be used at higher temperatures.

The presence of the polar amide or substituted amide moiety results in a peroxyacid which has a very low vapor pressure and thus possesses a low odor profile as well as excellent bleaching performance.

The peroxyacid can be used directly as a bleaching agent. The improved thermal stability of the peroxyacids of the invention, when mixed with a low level of exotherm control material and incorporated into the bleaching compositions and detergent compositions described hereinafter is surprisingly good, especially when compared to alkyl peroxyacids, especially the shorter chain peroxyacids of the prior art.

While not wishing to be bound by theory, it is believed that the polarity of the amide group results in a reduction of vapor pressure of the peroxyacid, and an increase in melting point.

The amide containing peroxyacids that have a reduced vapor pressure show good odor profiles.

The corresponding magnesium salts have the following general formulas:

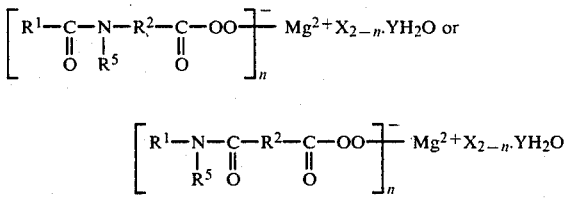

wherein $R^1$, $R^2$, and $R^5$, are as defined hereinbefore; n is either 1 or 2; X is any compatible anion; and Y is from 0 to about 6.

These magnesium salts are solid and possess good storage characteristics under alkaline conditions such as when admixed with a detergent composition. The active oxygen in the magnesium peroxycarboxylate is readily available. This means that the solid magnesium peroxycarboxylates are readily soluble or dispersible and yield solutions containing peroxyacids. When the solution is aqueous, it cannot be distinguished from an aqueous solution prepared from the corresponding peroxyacid and an equivalent amount of magnesium, when the solutions are adjusted to the same pH.

It is believed that the stability of the magnesium salt is due to the fact that the active oxygen atom is nucleophilic rather than electrophilic as it is in the corresponding peroxycarboxylic acid. Nucleophilic agents which would attack an electrophilic oxygen are much more prevalent in bleaching and detergent compositions than electrophilic agents.

The magnesium peroxycarboxylates can be prepared via the process of U.S. Pat. No. 4,483,781, Hartman, issued Nov. 20, 1984, incorporated herein by reference.

The Exotherm Control Agent

The exotherm control material is preferably selected from the group consisting of boric acid, urea, and mixtures thereof at a weight ratio of exotherm control material to peracid of from about 0.2:1 to, preferably, about 2:1, more preferably from about 0.2:1 to less than about 1:1 for boric acid, and, from about 0.5:1 to, preferably, about 2:1 for urea. The preferred exotherm control material from an efficiency standpoint is boric acid. Levels of exotherm agent greater than the preferred upper limits can be used, but are not needed.

It is an advantage of the specific peracid compounds herein that they require less exotherm control material than other peracid compounds. For example diperoxydodecanedioic acid requires almost five times as much boric acid to provide exotherm control. It is undesirable to have any more exotherm control material present than is absolutely necessary since they provide only minimal other benefit, if any.

The Bleaching Compositions

The bleaching compositions of the invention are those which, upon dissolution in aqueous solution, provide a bleaching compound of the formula

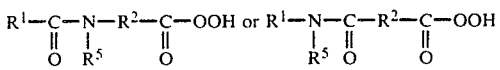

wherein $R^1$, $R^2$ and $R^5$ are as defined for the peroxyacid.

Such compositions provide extremely effective and efficient surface bleaching of textiles which thereby remove stains and/or soils from the textiles. The compositions are particularly effective at removing dingy soils from textiles. Dingy soils are soils that build up on textiles after numerous cycles of usage and washing, and thus, result in a white textile having a gray or yellow tint. These soils tend to be blend of particulate and greasy materials. The removal of this type of soil is sometimes referred to as "dingy fabric clean up".

The bleaching compositions provide such bleaching over a wide range of bleach solution temperatures. Such bleaching is obtained in bleach solutions wherein the solution temperature is at least about 5° C. Inorganic peroxygen bleaches would be ineffective and/or impracticable at temperatures below about 60° C.

Optional Components

As a preferred embodiment, the bleaching compositions of the invention can be detergent compositions. Such detergent compositions comprise from about 0.5% to about 30%, preferably from about 1% to about 6%, of the peroxyacid/exotherm control agent mixture; from about 1% to about 40%, preferably from about 2% to about 30%, of detergent surfactants; and from about 5% to about 80%, preferably from about 10% to about 60%, of detergency builder. Thus, the bleaching compositions can contain typical detergent composition components such as detergency surfactants and detergency builders. In such preferred embodiments the bleaching compositions are particularly effective. The bleaching compositions of this invention can contain all of the usual components of detergent compositions including the ingredients set forth in U.S. Pat. No. 3,936,537, Baskerville et al, incorporated herein by reference. Such components include color speckles, suds boosters, suds suppressors, antitarnish and/or anticorrosion agents, soil-suspending agents, soil-release agents, dyes, fillers, optical brighteners, germicides, alkalinity sources, hydrotropes, antioxidants, enzymes, enzyme stabilizing agents, perfumes, etc.

Enzymes are highly preferred optional ingredients and are incorporated in an amount of from about 0.025% to about 5%, preferably from about 0.05% to about 1.5%. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as "Alcalase" and "Savinase" sold by Novo Industries, and "Maxatase" and "Maxacal" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al, issued July 18, 1978, incorporated herein by reference.

The detergent surfactants can be any one or more surface active agents selected from anionic, nonionic, zwitterionic, amphoteric and cationic classes and compatible mixtures thereof. Detergent surfactants useful herein are listed in U.S. Pat. Nos. 3,664,961, Norris, issued May 23, 1972, and in 3,919,678, Laughlin et al, issued Dec. 30, 1975, both incorporated herein by reference. Useful cationic surfactants also include those described in U.S. Pat. Nos. 4,222,905, Cockrell, issued Sept. 16, 1980, and in 4,239,659, Murphy, issued Dec. 16, 1980, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, pottasium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

The level of detergent surfactant that can be employed is from 0% to about 50%, preferably from about 1% to about 30% and most preferably from about 10% to about 25% by weight of the total composition.

In addition to detergent surfactants, detergency builders can be employed in the bleaching compositions. Water-soluble inorganic or organic electrolytes are suitable builders. The builder can also be water-insoluble calcium ion exchange materials; non-limiting examples of suitable water-soluble, inorganic detergent builders include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediaminetetraacetates, N-(2-hydroxyethyl)nitrilodiacetates and diethylenetriaminepentaacetates; (2) water-soluble salts of phytic acid, for example, sodium and potassium phytates; (3) water-soluble polyphosphonates, including sodium, potassium, and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, carboxymethyloxysuccinic acid, tartrate mono- and disuccinates (ether linked), oxydisuccinate, 2-oxa-1,1,3-propane tricarboxylic acid, 1,1,2,2-ethane tetracarboxylic acid, mellitic acid and pyromellitic acid; and (5) water-soluble polyacetals as disclosed in U.S. Pat. Nos. 4,144,266 and 4,246,495 incorporated herein by reference.

Another type of detergency builder material useful in the present compositions comprises a water-soluble material capable of forming a water-soluble reaction product with water hardness cations preferably in combination with a crystallization seed which is capable of providing growth sites for said reaction product. Such "seeded builder" compositions are fully disclosed in British Pat. Specification No. 1,424,406.

A further class of detergency builder materials useful in the present invention are insoluble sodium aluminosilicates, particularly those described in U.S. Pat. No. 4,605,509, issued Aug. 12, 1986, incorporated herein by reference. This patent discloses and claims detergent compositions containing sodium aluminosilicates having the formula:

$$Na_z(AlO_2)_z(SiO_2)_yXH_2O$$

wherein z and y are integers equal to at least 6, the molar ratio of z to y is in the range of from 1.0:1 to about 0.5:1, and X is an integer from about 15 to about 264, said aluminosilicates having a calcium ion exchange capacity of at least 200 milligrams equivalent/gram and a calcium ion exchange rate of at least about 2 grains/-gallon/minute/gram. A preferred material is Zeolite A which is:

$$Na_{12}(SiO_2AlO_2)_{12}27H_2O$$

The level of detergency builder of the bleaching compositions is from 0% to about 70%, preferably from about 10% to about 60% and most preferably from about 20% to about 60%.

Buffering agents can be utilized and maintain the desired alkaline pH of the bleaching solutions. Buffering agents include, but are not limited to many of the detergency builder compounds disclosed hereinbefore. Buffering agents suitable for use herein are those well known in the detergency art.

Preferred optional ingredients include suds modifiers particularly those of suds suppressing types, exemplified by silicones, and silica-silicone mixtures.

U.S. Pat. Nos. 3,933,672, issued Jan. 20, 1976 to Bartolotta et al, and 4,136,045, issued Jan. 23, 1979 to Gault et al, incorporated herein by reference, disclose silicone suds controlling agents. The silicone material can be represented by alkylated polysiloxane materials such as silica aerogels and xerogels and hydrophobic silicas of various types. The silicone material can be described as siloxane having the formula:

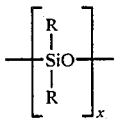

wherein x is from about 20 to about 2,000 and each R is an alkyl or aryl group, especially methyl, ethyl, propyl, butyl and phenyl groups. The polydimethylsiloxanes (both Rs are methyl) having a molecular weight within the range of from about 200 to about 2,000,000, and higher, are all useful as suds controlling agents. Additional suitable silicone materials wherein the side chain groups R are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpoly-siloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in U.S. Pat. No. 4,073,118, Gault et al, issued Feb. 21, 1978, incorporated herein by reference. An example of such a compound is DB-544, commercially available from Dow Corning, which is a siloxane/glycol copolymer.

Suds modifiers as described above are used at levels of up to approximately 2%, preferably from about 0.1 to about 1½% by weight of the surfactant.

Microcrystalline waxes having a melting point in the range from 35° C.–115° C. and a saponification value of less than 100 represent additional examples of preferred suds control components for use in the subject compositions, and are described in detail in U.S. Pat. No. 4,056,481, Tate, issued Nov. 1, 1977, incorporated herein by reference. The microcrystalline waxes are substantially water-insoluble, but are water-dispersible in the presence of organic surfactants. Preferred microcrystalline waxes have a melting point from about 65° C. to 100° C., a molecular weight in the range from 400–1,000; and a penetration value of at least 6, measured at 77° F. by ASTM-D1321. Suitable examples of the above waxes include: microcrystalline and oxidized microcrystalline petroleum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds control agent for use herein. These preferred phosphate esters are predominantly monostearyl phosphate which, in addition thereto, can contain di- and tristearyl phosphates and monooleyl phosphate, which can contain di- and trioleyl phosphate.

Other suds control agents useful in the practice of the invention are the soap or the soap and nonionic mixtures as disclosed in U.S. Pat. Nos. 2,954,347 and 2,954,348, incorporated herein by reference.

The following examples are given to illustrate the parameters of and compositions within the invention. All percentages, parts and ratios are by weight unless otherwise indicated.

EXAMPLE I

Preparation of 4-Nonylamino-4-Oxoperoxybutyric Acid (1)

4-Nonylamino-4-Oxobutyric Acid

To a stirred solution of succinic anhydride (25.0 g, 0.25 mol) in 150 mL acetone was added dropwise 35.8 g (0.25 mol) of nonylamine. The addition of the amine required 15 minutes, with the acetone solution reaching reflux before the addition was complete. Five minutes after the end of addition, a precipitate formed and the reaction mixture quickly became thick with suspended solids. Following addition of the amine the reaction mixture was stirred at room temperature for 1 hr. The precipitated solid was collected by filtration and washed with cold acetone. Air drying afforded 48.5 g of 4-nonylamino-4-oxobutyric acid as white, fluffy crystals, mp 114°–115.5° C. Upon standing the filtrate deposited crystals which were collected by filtration, washed with cold acetone, and air dried to yield an additional 10.9 g of the acid, mp 114°–115.5° C. Total yield was 59.4 g (98% of theoretical).

4-Nonylamino-4-Oxoperoxybutyric Acid (1)

A 500 mL beaker was charged with 50.0 g (0.205 mol) of 4-nonylamino-4-oxobutyric acid and 100 mL of 98% methanesulfonic acid. The resulting solution was cooled in an ice bath and, with stirring, 38.8 g of 90% hydrogen peroxide (34.9 g, 1.03 mol of hydrogen peroxide) was added dropwise at a rate such that the temperature of the reaction mixture did not rise above 20° C.

(required 10 minutes). The solution was stirred at room temperature for 1.5 hours, cooled to −15° C., and poured over ice. The precipitated solid was collected by filtration and washed with water. The filter cake was reslurried with water, filtered, and washed with water. The wet filter cake was dissolved in 250 mL of 60° C. ethyl acetate, the water layer removed with a pipet, and the ethyl acetate solution cooled to −15° C. The crystals which formed were collected by filtration, washed with −15° C. ethyl acetate, and air dried to yield 47.5 g of 4-nonylamino-4-oxoperoxybutyric acid (1), mp 85°-91° C., analysis for available oxygen (AvO)=5.61%. Theoretical yield=53.2 g having an AvO of 6.17%.

Preparation of 6-Nonylamino-6-Oxocaproic Acid (2)

5-Carbomethoxyvaleryl Chloride

This ester/acid chloride was prepared as described in *Org. Synthesis Coll.* Vol. 4, 556 (1963), incorporated herein by reference.

The monomethylester of adipic acid (100 g, 0.624 mol) and thionyl chloride (148.6 g, 1.248 mol) were charged into a round-bottom flask which was then fitted with a drying tube. The reaction mixture was allowed to stand at room temperature overnight in a hood. Heptane (100 mL) was added and the excess thionyl chloride was removed on a rotary evaporator. This procedure of adding 100 mL heptane and stripping on a rotary evaporator was repeated two additional times to yield 111.5 g (0.624 mol) of the ester/acid chloride as a yellow oil.

6-Nonylamino-6-Oxocaproic Acid, Methyl Ester

A two liter beaker fitted with a mechanical stirrer, ice bath, and pH electrode, was charged with 700 mL of water and 89.4 g (0.624 mol) of nonylamine in 200 mL of ether. To this stirred mixture was added dropwise over a 30 minute period a solution of the above 5-carbomethoxyvaleryl chloride in 100 mL of ether. Concurrent with addition of the ether solution was added 50% sodium hydroxide solution at a rate such as to keep the pH of the aqueous layer between 10 and 12. Following addition of the acid chloride and sodium hydroxide the reaction mixture was added to a two L separatory funnel and extracted with 300 mL methylene chloride. The methylene chloride layer was separated, washed with 300 mL saturated sodium chloride solution, and dried over magnesium sulfate. Removal of the methylene chloride on a rotary evaporator yielded a yellow oil which solidified upon standing. Recrystallization from hexane afforded the methylester of 6-nonylamino-6-oxocaproic acid as colorless crystals, mp 56°-57° C., weight 155.1 g. Upon cooling to −15° C. the filtrate deposited an additional 11.0 of product. Total yield was 166.1 g (93%).

6-Nonylamino-6-Oxoperoxycaproic Acid (2)

6-Nonylamino-6-oxoperoxycaproic acid was prepared according to the procedure described hereinbefore for the butyric acid derivative. From 100 g (0.350 mol) of the monomethyl ester of 6-nonylamino-6-oxocaproic acid, 66.2 g of 90% hydrogen peroxide (59.6 g, 1.75 mol of hydrogen peroxide), and 300 mL of 98% methanesulfonic acid was obtained 80.3 g of 6-nonylamino-6-oxoperoxycaproic acid (2), AvO=4.99% mp 83°-87° C. (theoretical yield=100.7 g with 5.57% AvO).

Evaluation of Exotherm Control Agents

Test Apparatus and Procedure

A Pyrex dish (15 cm in diameter and 7 cm in depth) was filled to a depth of 4 cm with Fisher High Temperature Bath Oil [flash point 360°-390° F. (182°-199° C.)]. The bath was placed on a combination magnetic stirrer/hot plate and, with stirring, the bath oil was heated to 125° C.

A borosilicate glass culture tube (CMS, 18×150 mm) was charged with 0.5 g (weighed accurately) of the organic peroxyacid and an accurately measured weight of the exotherm control agent under evaluation. The materials were intimately mixed with a spatula, the tube tapped to settle the contents, and the tube immersed in the high-temperature bath so that the oil level was above the content level. In all cases, vertical and overhead safety shields were employed to protect the operator. The behavior of the sample with respect to melting and exotherm was observed visually and noted versus time after immersion of the sample.

Criteria Used to Determine if the Exothermic Decomposition is Controlled by the Added Agent Whether or not the exothermic decomposition of the organic peroxyacid was controlled by a given amount of added agent was determined by visual observation of the sample. The exothermic decomposition of the peroxyacid was judged to be under control if the release of energy from the decomposition was orderly and modulated relative to the peroxyacid alone, and the sample behavior fulfilled all of the following criteria:

1. The sample did not erupt from the tube.
2. Release of gaseous products did not occur suddenly as evidenced by a whooshing sound.
3. The sample did not make a popping or crackling sound.
4. This sample did not discolor, indicating that the temperature rise within the sample was insufficient to cause charring. Versus this criteria, either a faint yellow color or evidence that the discoloration did not result from a rise in the internal temperature of the sample are acceptable. This latter situation may exist when the discoloration is due to a chemical reaction rather than a thermal process, and is evidenced by discoloration occurring at virtually all ratios of exotherm control agent to peroxyacid.
5. The sample did not ignite.
6. The sample did not explode.

Control of the Exotherms of 4-Nonylamino-4-Oxoperoxybutyric Acid (1), 6-Nonylamino-6-Oxocaproic Acid (2), and Diperoxydodecanedioic Acid (DPDA) by Admixture with Boric Acid The exothermic decompositions of mixtures of 1, 2, and DPDA with boric acid were studied using the procedure and criteria described above. Peroxyacid 1 contained 5.99% AvO (97% of theoretical), peroxyacid 2 contained 5.42% AvO (97% of theoretical). and DPDA contained 11.18% AvO (92% of theoretical). The boric acid (Fisher) was used as received.

Exothermic Decomposition of Mixtures of Peroxyacids and Boric Acid at 125° C.
(+) = Exothermic Decomposition Controlled
(−) = Exothermic Decomposition Not Controlled

| Weight Ratio $H_3BO_3$: Peroxyacid | Peroxyacid 1 | Peroxyacid 2 | DPDA |
|---|---|---|---|
| 0 | (−) | (−) | (−) |

-continued

Exothermic Decomposition of Mixtures of Peroxyacids and Boric Acid at 125° C.
(+) = Exothermic Decomposition Controlled
(−) = Exothermic Decomposition Not Controlled

| Weight Ratio $H_3BO_3$: Peroxyacid | Peroxyacid 1 | Peroxyacid 2 | DPDA |
|---|---|---|---|
| 0.05 | (−) | | |
| 0.10 | (−) | | |
| 0.15 | (−) | | |
| 0.20 | (+) | (+) | |
| 0.50 | (+) | (+) | (−) |
| 1.0 | (+) | (+) | (+) |

Control of the Exothermic Decomposition of Mixtures of 4-Nonylamino-4-Oxoperoxybutyric Acid (1) With Magnesium Sulfate.$7H_2O$, Urea, Maleic Acid, and DL-Malic Acid The exothermic decomposition of mixtures of 1 with magnesium sulfate.$7H_2O$, urea, maleic acid, and DL-malic acid were studied using the procedure and criteria described above. Peroxyacid 1 contained 5.99% AvO (97% of theoretical). The magnesium sulfate.$7H_2O$ and urea were from Fisher and were powdered with a mortar and pestle before use. The maleic acid and DL-malic acid samples were from Aldrich and were also powdered before use.

Exothermic Decomposition of Mixtures of Peroxyacids and Control Agents at 125° C.
(+) = Exothermic Decomposition Controlled
(−) = Exothermic Decomposition Not Controlled

| Weight Ratio Control Agent: Peroxyacid 1 | Control Agent $MgSO_4.7H_2O$ | Urea | Maleic* | DL-Malic Acid |
|---|---|---|---|---|
| 0.20 | | (−) | | |
| 0.30 | | (−) | | |
| 0.40 | | (−) | | |
| 0.50 | (−) | (+) | | |
| 0.60 | (−) | | | |
| 0.70 | (−) | | | |
| 0.80 | (−) | | | |
| 1.0 | (−) | (+) | (−) | (−) |
| 1.5 | (−) | | (−) | (−) |
| 2.0 | (+) | (+) | (−) | (−) |
| 3.0 | | (+) | | |
| 4.0 | | | (+) | |
| 8.0 | | | (+) | |

*All mixtures of 1 with maleic acid turned yellow or brown; based on observed degree of severity of the exothermic decomposition and the fact that the 8:1 ratio also discolored, it was judged that the 4:1 ratio was the onset of control of the exothermic decomposition.

What is claimed is:

1. A bleaching composition comprising a mixture of:

(1) a peroxyacid compound of the following general formulas:

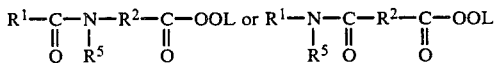

wherein $R^1$ and $R^2$ are alkyl(ene), aryl(ene) or alkaryl(ene) groups containing from about 1 to about 14 carbon atoms; $R^5$ is H or an alkyl, aryl, or alkaryl group containing from about 1 to about 10 carbon atoms; and L is either H or $Mg^{2+}X_{2-n}.YH_2O$ wherein X is a compatible anion, n is one or two, and Y is from O to about 6; and (2) an exotherm control agent selected from the group consisting of boric acid, urea, and mixtures thereof at a weight ratio of exotherm control agent to peroxyacid compound of more than about 0.2:1 for the boric acid and more than about 0.5:1 for the urea.

2. The composition of claim 1 wherein the exotherm control agent is boric acid.

3. The composition of claim 1 wherein the exotherm control agent is urea.

4. The composition of claim 1 wherein $R^1$ contains from about 6 to about 12 carbon atoms, $R^2$ contains from about 2 to about 8 carbon atoms, $R^5$ is H, and $R^1$ and $R^5$ together contain no more than about 18 carbon atoms.

5. The composition of claim 4 wherein the exotherm control agent is boric acid.

6. The composition of claim 4 wherein the exotherm control agent is urea.

7. A detergent composition comprising:

(1) from about 0.5% to about 30% of the mixture of claim 1;

(2) from about 1% to about 30% detergent surfactant; and (3) from about 10% to about 60% of detergency builder.

8. The detergent composition of claim 7 wherein, in (1), the exotherm control agent is boric acid.

9. The detergent composition of claim 7 wherein, in (1), the exotherm control agent is urea.

10. The composition of claim 7 wherein, in (1), $R^1$ contains from about 6 to about 12 carbon atoms, $R^2$ contains from about 2 to about 8 carbon atoms, $R^5$ is H, and $R^1$ and $R^5$ together contain no more than about 18 carbon atoms.

11. The composition of claim 10 wherein the exotherm control agent is boric acid.

12. The composition of claim 10 wherein the exotherm control agent is urea.

13. The composition of claim 1 wherein the weight ratio of boric acid to peroxyacid compound is less than about 1:1 and the weight ratio of urea to peroxyacid is less than about 2:1.

14. The composition of claim 13 wherein the exotherm control agent is boric acid.

15. The composition of claim 13 wherein the exotherm control agent is urea.

16. The composition of claim 13 wherein $R^1$ contains from about 6 to about 12 carbon atoms, $R^2$ contains from about 2 to about 8 carbon atoms, $R^5$ is H, and $R^1$ and $R^5$ together contain no more than about 18 carbon atoms.

17. A detergent composition comprising:

(1) from about 0.5% to about 30% of the mixture of claim 13;

(2) from about 1% to about 30% detergent surfactant; and (3) from about 10% to about 60% of detergency builder.

18. The detergent composition of claim 17 wherein, in (1), the exotherm control agent is boric acid.

19. The detergent composition of claim 17 wherein, in (1), the exotherm control agent is urea.

* * * * *